US009561924B2

(12) United States Patent
Azeta et al.

(10) Patent No.: US 9,561,924 B2
(45) Date of Patent: Feb. 7, 2017

(54) RECORDING MEDIUM CONVEYANCE APPARATUS AND IMAGE FORMING APPARATUS

(71) Applicant: CANON KABUSHIKI KAISHA, Tokyo (JP)

(72) Inventors: Takahiro Azeta, Kawasaki (JP); Toshiyuki Watanabe, Yokohama (JP); Kazuhiro Hosohara, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/938,214

(22) Filed: Nov. 11, 2015

(65) Prior Publication Data

US 2016/0137443 A1 May 19, 2016

(30) Foreign Application Priority Data

Nov. 19, 2014 (JP) ..... 2014-234096

(51) Int. Cl.
*B65H 5/26* (2006.01)
*B65H 5/06* (2006.01)

(52) U.S. Cl.
CPC ..... *B65H 5/26* (2013.01); *B65H 5/062* (2013.01); *B65H 2403/40* (2013.01); *B65H 2403/42* (2013.01); *B65H 2403/422* (2013.01); *B65H 2403/481* (2013.01); *B65H 2403/70* (2013.01); *B65H 2403/72* (2013.01); *B65H 2403/80* (2013.01)

(58) Field of Classification Search
CPC . B65H 5/26; B65H 2403/00; B65H 2403/481; B65H 2403/40; B65H 2403/42; B65H 2403/422; B65H 2403/70; B65H 2403/72; B65H 2403/80
USPC ..... 271/4.04, 10.04
See application file for complete search history.

(56) References Cited

U.S. PATENT DOCUMENTS

| | | | |
|---|---|---|---|
| 4,953,846 | A | 9/1990 | Azeta et al. |
| 5,162,857 | A | 11/1992 | Higeta et al. |
| 5,448,348 | A | 9/1995 | Azeta |
| 5,501,444 | A | 3/1996 | Yukimachi et al. |
| 6,179,287 | B1 | 1/2001 | Watanabe et al. |
| 6,658,229 | B2 | 12/2003 | Ando et al. |

(Continued)

FOREIGN PATENT DOCUMENTS

| | | | |
|---|---|---|---|
| JP | 2009-222924 | A | 10/2009 |

*Primary Examiner* — Patrick Cicchino
(74) *Attorney, Agent, or Firm* — Fitzpatrick, Cella, Harper & Scinto

(57) ABSTRACT

The apparatus includes a first clutch and a second clutch. The first clutch transmits rotation of the driving unit in a first rotation direction to the first feeding device without transmitting rotation of the driving unit in a second rotation direction that is reverse to the first rotation direction to the first feeding device. The second clutch transmits the rotation of the driving unit in the second rotation direction to the conveyance device and the double-side printing conveyance device and without transmitting the rotation of the driving unit in the first rotation direction to the conveyance device and the double-side printing conveyance device. The third transmission path is configured to transmit the rotation of the driving unit to a conveyance device. The fourth transmission path is configured to transmit the rotation of the driving unit to a double-side printing conveyance device.

14 Claims, 8 Drawing Sheets

(56) References Cited

U.S. PATENT DOCUMENTS

| | | | | |
|---|---|---|---|---|
| 6,754,456 | B2 * | 6/2004 | Ahn | G03G 15/234 399/401 |
| 6,810,224 | B2 * | 10/2004 | Ahn | G03G 15/232 399/167 |
| 7,050,751 | B2 | 5/2006 | Watanabe et al. | |
| 7,896,343 | B2 * | 3/2011 | Iwago | H04N 1/00572 271/186 |
| 8,328,179 | B2 * | 12/2012 | Shimomura | B65H 5/26 271/10.04 |
| 2004/0124575 | A1 * | 7/2004 | Lee | B65H 3/08 271/10.01 |
| 2010/0032887 | A1 * | 2/2010 | Morinaga | B65H 3/0661 271/10.12 |
| 2010/0143013 | A1 | 6/2010 | Azeta | |
| 2013/0256976 | A1 * | 10/2013 | Samoto | B65H 5/06 271/10.11 |
| 2013/0256983 | A1 * | 10/2013 | Horade | B65H 5/00 271/225 |
| 2014/0062001 | A1 * | 3/2014 | Nogami | B65H 3/06 271/109 |
| 2014/0167346 | A1 * | 6/2014 | Iijima | B65H 5/26 271/3.15 |
| 2016/0090258 | A1 * | 3/2016 | Sano | B65H 85/00 271/225 |

* cited by examiner

RECORDING MEDIUM CONVEYANCE APPARATUS AND IMAGE FORMING APPARATUS

BACKGROUND OF THE INVENTION

Field of the Invention

The present invention relates to a recording medium conveyance apparatus configured to convey recording media, and to an image forming apparatus including the recording medium conveyance apparatus.

Description of the Related Art

Hitherto, there have been such demands that image forming apparatus such as a copying machine, a printer, and a facsimile machine be reduced in cost and have a function of double-side printing on recording media.

In Japanese Patent Application Laid-Open No. 2009-222924, there is disclosed such a configuration that recording media in a feeding tray are fed by a first feeding roller, or recording media on a manual feeding tray are fed by a second feeding roller arranged independently of the first feeding roller so that images are formed on the recording media by image forming devices. Further, in the configuration disclosed in Japanese Patent Application Laid-Open No. 2009-222924, in order to form images on both sides of the recording medium, the recording medium having an image formed on one-side of the recording medium is conveyed again to the image forming devices by a double-side printing roller pair so that an image is formed on another side of the recording medium.

In the configuration disclosed in Japanese Patent Application Laid-Open No. 2009-222924, in order to convey the recording media, while the first feeding roller and the second feeding roller are rotated in one direction, the double-side printing roller pair needs to be rotated.

However, in Japanese Patent Application Laid-Open No. 2009-222924, how the first feeding roller, the second feeding roller, and the double-side printing roller pair are driven to rotate is not disclosed. When a motor configured to rotate each of the first feeding roller and the second feeding roller and a motor configured to rotate the double-side printing roller pair are arranged independently of each other, cost is increased.

SUMMARY OF THE INVENTION

It is an object of the present invention to enable a first feeding device, a second feeding device, a conveyance device, and a double-side printing conveyance device to be driven by a single driving unit, and to prevent all the loads from being applied to the single driving unit at once when driving the driving unit, to thereby achieve cost reduction and space saving of an apparatus.

In order to achieve the above-mentioned object, one object of the present invention is to provide a recording medium conveyance apparatus, including: a driving unit configured to be driven to rotate in a first rotation direction and a second rotation direction that is reverse to the first rotation direction; a first feeding device configured to feed a recording medium; a first transmission path configured to transmit rotation of the driving unit to the first feeding device; a first clutch arranged on the first transmission path, which is configured to transmit rotation of the driving unit in the first rotation direction to the first feeding device and not transmit rotation of the driving unit in the second rotation direction to the first feeding device; a second feeding device arranged independently of the first feeding device, which is configured to feed a recording medium; a second transmission path configured to transmit the rotation of the driving unit to the second feeding device; a double-side printing conveyance device arranged on a double-side sheet conveyance path; a conveyance device configured to convey the recording medium fed by one of the first feeding device and the second feeding device; a third transmission path configured to transmit the rotation of the driving unit to the conveyance device; a fourth transmission path including a branch portion branched from the third transmission path, which is configured to transmit the rotation of the driving unit to the double-side printing conveyance device; and a second clutch arranged one of at the branch portion and on a transmission path between the driving unit and the branch portion, which is configured to transmit the rotation of the driving unit in the second rotation direction to the conveyance device and the double-side printing conveyance device and not transmit the rotation of the driving unit in the first rotation direction to the conveyance device and the double-side printing conveyance device.

Another object of the present invention is to provide a recording medium conveyance apparatus, including: a driving unit configured to rotate by a driving force in a first rotation direction and a second rotation direction that is reverse to the first rotation direction; a first feeding device configured to feed a recording medium; a first transmission path configured to transmit rotation of the driving unit to the first feeding device; a first clutch arranged on the first transmission path, which is configured to transmit rotation of the driving unit in the first rotation direction to the first feeding device and regulate transmission of rotation of the driving unit in the second rotation direction to the first feeding device; a second feeding device arranged independently of the first feeding device, which is configured to feed a recording medium; a second transmission path configured to transmit the rotation of the driving unit to the second feeding device; a double-side printing conveyance device arranged on a double-side sheet conveyance path; a conveyance device configured to convey the recording medium fed by one of the first feeding device and the second feeding device; a third transmission path configured to transmit the rotation of the driving unit to the conveyance device; a fourth transmission path including a branch portion branched from the third transmission path, which is configured to transmit the rotation of the driving unit to the double-side printing conveyance device; and a second clutch arranged one of at the branch portion and on a transmission path between the driving unit and the branch portion, which is configured to transmit the rotation of the driving unit in the second rotation direction to the conveyance device and the double-side printing conveyance device and regulate transmission of the rotation of the driving unit in the first rotation direction to the conveyance device and the double-side printing conveyance device.

Still another object of the present invention is to provide an image forming apparatus, including: a recording medium conveyance apparatus configured to convey a recording medium; and a transfer portion configured to transfer an image onto the recording medium fed to the recording medium conveyance apparatus, the recording medium conveyance apparatus including: a driving unit configured to rotate by a driving force in a first rotation direction and a second rotation direction that is reverse to the first rotation direction; a first feeding device configured to feed a recording medium; a first transmission path configured to transmit rotation of the driving unit to the first feeding device; a first clutch arranged on the first transmission path, which is configured to transmit rotation of the driving unit in the first rotation direction to the first feeding device and not transmit rotation of the driving unit in the second rotation direction to the first feeding device; a second feeding device arranged independently of the first feeding device, which is configured to feed a recording medium; a second transmission path configured to transmit the rotation of the driving unit to the second feeding device; a double-side printing conveyance device arranged on a double-side sheet conveyance path; a conveyance device configured to convey the recording medium fed by one of the first feeding device and the second feeding device; a third transmission path configured to transmit the rotation of the driving unit to the conveyance device; a fourth transmission path including a branch portion branched from the third transmission path, which is configured to transmit the rotation of the driving unit to the double-side printing conveyance device; and a second clutch arranged one of at the branch portion and on a transmission path between the driving unit and the branch portion, which is configured to transmit the rotation of the driving unit in the second rotation direction to the conveyance device and the double-side printing conveyance device and not transmit the rotation of the driving unit in the first rotation direction to the conveyance device and the double-side printing conveyance device.

Further features of the present invention will become apparent from the following description of exemplary embodiments with reference to the attached drawings.

DESCRIPTION OF THE EMBODIMENTS

Now, an exemplary embodiment of the present invention is illustratively described in detail with reference to the drawings. Note that, dimensions, materials, and shapes of components described in the following embodiment, and their relative positions, are subject to appropriate change in accordance with a configuration and various conditions of an apparatus to which the present invention is applied. Accordingly, as long as there is no specific description, the scope of the present invention is not intended to be limited only to the dimensions, materials, shapes, and relative positions.

Now, with reference to FIG. 1 to FIG. 9, a recording medium conveyance apparatus and an image forming apparatus including the recording medium conveyance apparatus according to an embodiment of the present invention are described.

Note that, in the embodiment described below, a full-color electrophotographic image forming apparatus to which four process cartridges are mounted in a removable manner is illustrated as an example of the image forming apparatus.

However, the number of the process cartridges to be mounted to this electrophotographic image forming apparatus (hereinafter referred to as "image forming apparatus") is not limited thereto, and may be set appropriately as necessary. For example, when the image forming apparatus is configured to form monochromatic images, a single process cartridge is mounted to the image forming apparatus.

Further, in the embodiment described below, a printer is illustrated as an example of the image forming apparatus. However, the present invention is not limited thereto, and is applicable to, for example, image forming apparatus of other types such as a copying machine and a facsimile machine, and image forming apparatus of still other types such as a multifunction peripheral having combined functions of those machines.

<<Schematic Configuration of Image Forming Apparatus>>

Figure 1:
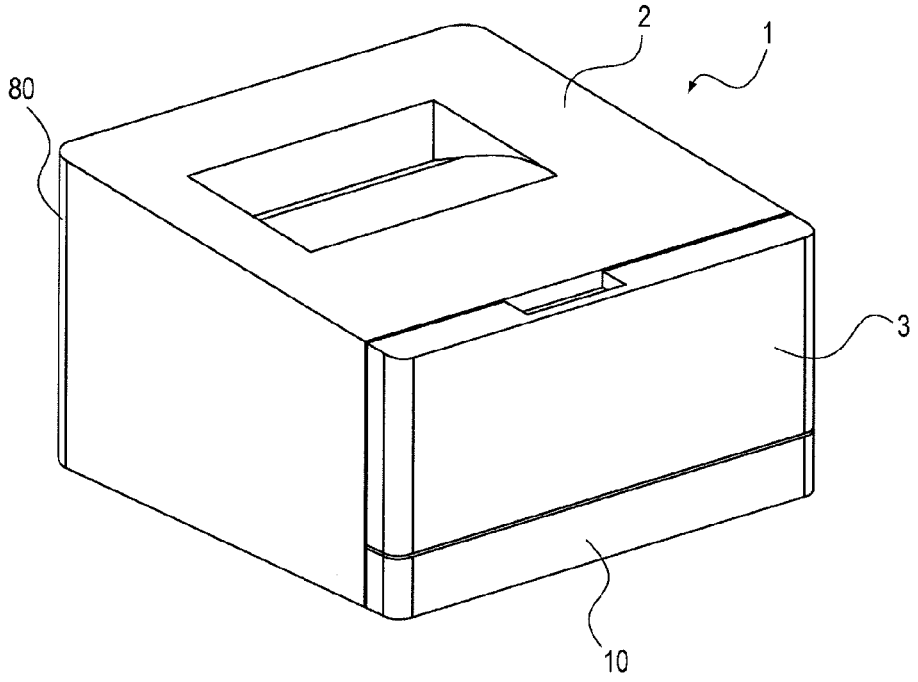
FIG. 1 is an external perspective view for illustrating an example of an image forming apparatus according to the present invention.
Figure 2:
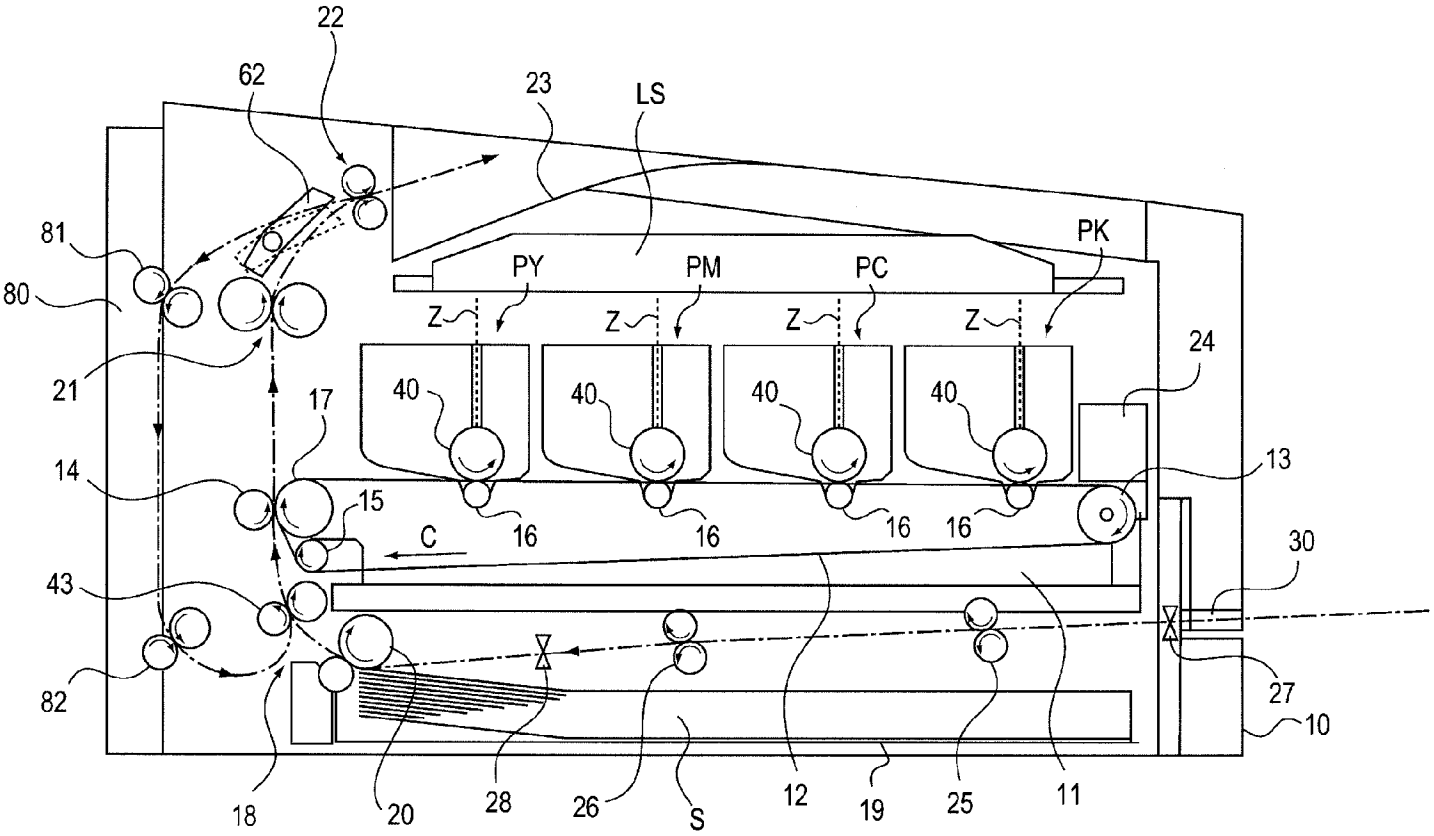
FIG. 2 is a schematic sectional view for illustrating the example of the image forming apparatus according to the present invention.

First, a schematic configuration of the image forming apparatus is described. FIG. 1 is an external perspective view for illustrating the image forming apparatus of this embodiment. FIG. 2 is a schematic sectional view for illustrating the image forming apparatus of this embodiment.

This image forming apparatus 1 is an electrophotographic four-full-color laser printer configured to form color images onto recording media. The image forming apparatus 1 employs a process cartridge system, in which process cartridges P (hereinafter referred to as "cartridges") are mounted in a removable manner to a main body 2 of the image forming apparatus 1 so that color images are formed on recording media S.

Note that, in the image forming apparatus 1, a side on which an apparatus openable/closable door 3 is arranged is referred to as a front side (near side), and a side opposite to the front side on which a double-side printing unit 80 described below is arranged is referred to as a rear side (far side). Further, a right side and a left side in a front view of the image forming apparatus 1 are respectively referred to as a driving side and a non-driving side.

In the main body 2 of the image forming apparatus 1, four cartridges P (PY, PM, PC, and PK), that is, a first cartridge PY, a second cartridge PM, a third cartridge PC, and a fourth cartridge PK are arranged in a horizontal direction. A rotational driving force is transmitted from an image formation driving motor (not shown) of the main body 2 of the image forming apparatus 1 to the first to fourth cartridges P (PY, PM, PC, and PK). In addition, bias voltages (such as a charging bias and a developing bias) (not shown) are supplied from the main body 2 of the image forming apparatus 1 to the first to fourth cartridges P (PY, PM, PC, and PK).

The first to fourth cartridges P (PY, PM, PC, and PK) each have a similar electrophotographic process mechanism, and respectively contain developers (hereinafter referred to as "toners") of different colors. The first cartridge PY contains a toner of yellow (Y), and is configured to form a toner image of yellow on a surface of a corresponding photosensitive drum 40. The second cartridge PM contains a toner of magenta (M), and is configured to form a toner image of magenta on a surface of a corresponding photosensitive drum 40. The third cartridge PC contains a toner of cyan (C), and is configured to form a toner image of cyan on a surface of a corresponding photosensitive drum 40. The fourth cartridge PK contains a toner of black (K), and is configured to form a toner image of black on a surface of a corresponding photosensitive drum 40.

A laser scanner unit LS serving as an exposure device is arranged above the first to fourth cartridges P (PY, PM, PC, and PK). The laser scanner unit LS is configured to output laser beams Z in accordance with image information. The laser beams Z pass through exposure window portions of the cartridges P, to thereby scan and expose the surfaces of the photosensitive drums 40.

An intermediate transfer belt unit 11 serving as a transfer member is arranged below the first to fourth cartridges P (PY, PM, PC, and PK). The intermediate transfer belt unit 11 includes a driving roller 13, a turn roller 17, a tension roller 15, and a flexible transfer belt 12 that is looped around those three rollers 13, 17, and 15.

The photosensitive drums 40 of the first to fourth cartridges P (PY, PM, PC, and PK) are held in contact with an upper surface of the transfer belt 12, and contact portions therebetween serve as primary transfer portions. On an inner side of the transfer belt 12, primary transfer rollers 16 are arranged so as to face the photosensitive drums 40.

A secondary transfer roller 14 is held in abutment against the turn roller 17 through intermediation of the transfer belt 12. A contact portion between the transfer belt 12 and the secondary transfer roller 14 serves as a secondary transfer portion.

A feeding unit 18 is arranged below the intermediate transfer belt unit 11. The feeding unit 18 includes a feeding tray 19 configured to receive and allow the recording media S to be stacked therein, and a feeding roller 20 serving as a second feeding device configured to feed the recording media S from the feeding tray 19.

On the near side with respect to the feeding roller 20, feeding rollers 25 and 26 serving as first feeding devices are arranged, which are configured to feed the recording media S manually fed through a manual feeding port 30. Further, near the manual feeding port 30, a recording medium detecting device 27 is arranged, which is configured to detect the manually fed recording media S.

The recording media S manually fed through the manual feeding port 30 are detected by the recording medium detecting device 27. Then, the feeding rollers 25 and 26 for manual feeding are driven to rotate. With this, the manually fed recording media S are guided to the feeding roller 20 by the feeding rollers 25 and 26 for manual feeding, to thereby be fed similarly to the recording media S stacked in the feeding tray 19.

A fixing unit 21 and delivery rollers 22 are arranged at an upper part on the far side in the main body 2 of the image forming apparatus 1. An upper surface of the main body 2 of the image forming apparatus 1 serves as a delivery tray 23. The recording media S are subjected to fixation of the toner images by a fixing device arranged in the fixing unit 21, and then delivered onto the delivery tray 23 by the delivery rollers 22.

<<Image Forming Operation>>

An operation of forming a full-color image in the image forming apparatus configured as described above is described.

The photosensitive drums 40 of the first to fourth cartridges P (PY, PM, PC, and PK) are driven to rotate at a predetermined speed (in the direction of the arrows in FIG. 2, that is, counterclockwise direction). The transfer belt 12 is also driven to rotate at a speed based on the speed of the photosensitive drums 40 in a direction following the rotation of the photosensitive drums (in the direction of the arrow C in FIG. 2).

The laser scanner unit LS scans and exposes the surfaces of the photosensitive drums 40 with the laser beams Z in accordance with image signals of the respective colors. With this, electrostatic latent images corresponding to the image signals of the respective colors are formed on the surfaces of the photosensitive drums 40. The electrostatic latent images formed on the surfaces of the photosensitive drums 40 are developed by developing rollers (not shown) driven to rotate at a predetermined speed.

Through the operation of the electrophotographic image forming process as described above, a yellow toner image corresponding to a yellow component of the full-color image is formed on the photosensitive drum 40 of the first cartridge PY. Then, this toner image is primarily transferred onto the transfer belt 12 at the primary transfer portion at which the photosensitive drum 40 and the primary transfer roller 16 face each other.

Similarly, a magenta toner image corresponding to a magenta component of the full-color image is formed on the photosensitive drum 40 of the second cartridge PM. Then, this toner image is primarily transferred in a superimposed manner onto the yellow toner image that has already been transferred onto the transfer belt 12 at the primary transfer portion at which the photosensitive drum 40 and the primary transfer roller 16 face each other.

Similarly, a cyan toner image corresponding to a cyan component of the full-color image is formed on the photosensitive drum 40 of the third cartridge PC. Then, this toner image is primarily transferred in a superimposed manner onto the yellow and magenta toner images that have already been transferred onto the transfer belt 12 at the primary transfer portion at which the photosensitive drum 40 and the primary transfer roller 16 face each other.

Similarly, a black toner image corresponding to a black component of the full-color image is formed on the photosensitive drum 40 of the fourth cartridge PK. Then, this toner image is primarily transferred in a superimposed manner onto the yellow, magenta, and cyan toner images that have already been transferred onto the transfer belt 12 at the primary transfer portion at which the photosensitive drum 40 and the primary transfer roller 16 face each other.

In this way, the unfixed toner images of the four full colors of yellow, magenta, cyan, and black are formed on the transfer belt 12.

Meanwhile, the recording media S are separated one by one and fed at a predetermined control timing. The recording media S received in the feeding tray 19 are separated one by one and fed by the feeding roller 20. Alternatively, the recording medium S manually fed through the manual feeding port 30 is conveyed by the feeding rollers 25 and 26 for manual feeding, and then fed by the feeding roller 20. The recording medium S is guided to the secondary transfer portion, that is, the abutment portion between the secondary transfer roller 14 and the transfer belt 12 at a predetermined control timing by conveyance rollers (hereinafter referred to as "registration rollers") 43 serving as a conveyance device.

With this, through the process of the conveyance of the recording medium S to the secondary transfer portion, the four-color toner images that are superimposed on each other on the transfer belt 12 are collectively transferred sequentially onto a surface of the recording medium S.

At the time of double-side printing, after a vicinity of a trailing edge of the recording medium S reaches the delivery rollers 22, a switching member 62 is moved to a double-side printing conveyance position (position indicated by the broken line in FIG. 2) by a driving unit (not shown). Then, the delivery rollers 22 is reversely rotated by a driving unit (not shown) so as to convey the recording medium S to the double-side printing unit 80. The double-side printing unit 80, which is configured to be openable and closable with respect to the main body 2 of the image forming apparatus 1, is described in detail below.

Next, double-side sheet conveyance rollers 81 and 82 serving as double-side printing conveyance devices in the double-side printing unit 80 convey the recording medium S to the registration rollers 43 serving as the conveyance device including a skew-feeding correcting device. The double-side sheet conveyance rollers 81 and 82 are arranged on a double-side sheet conveyance path configured to guide the recording medium S in the double-side printing unit 80. After that, the recording medium S is subjected to printing on a second side similarly to the printing on the first side (double-side printing), and then delivered.

<<Configuration of Driving Gear Train>>

Figure 3:
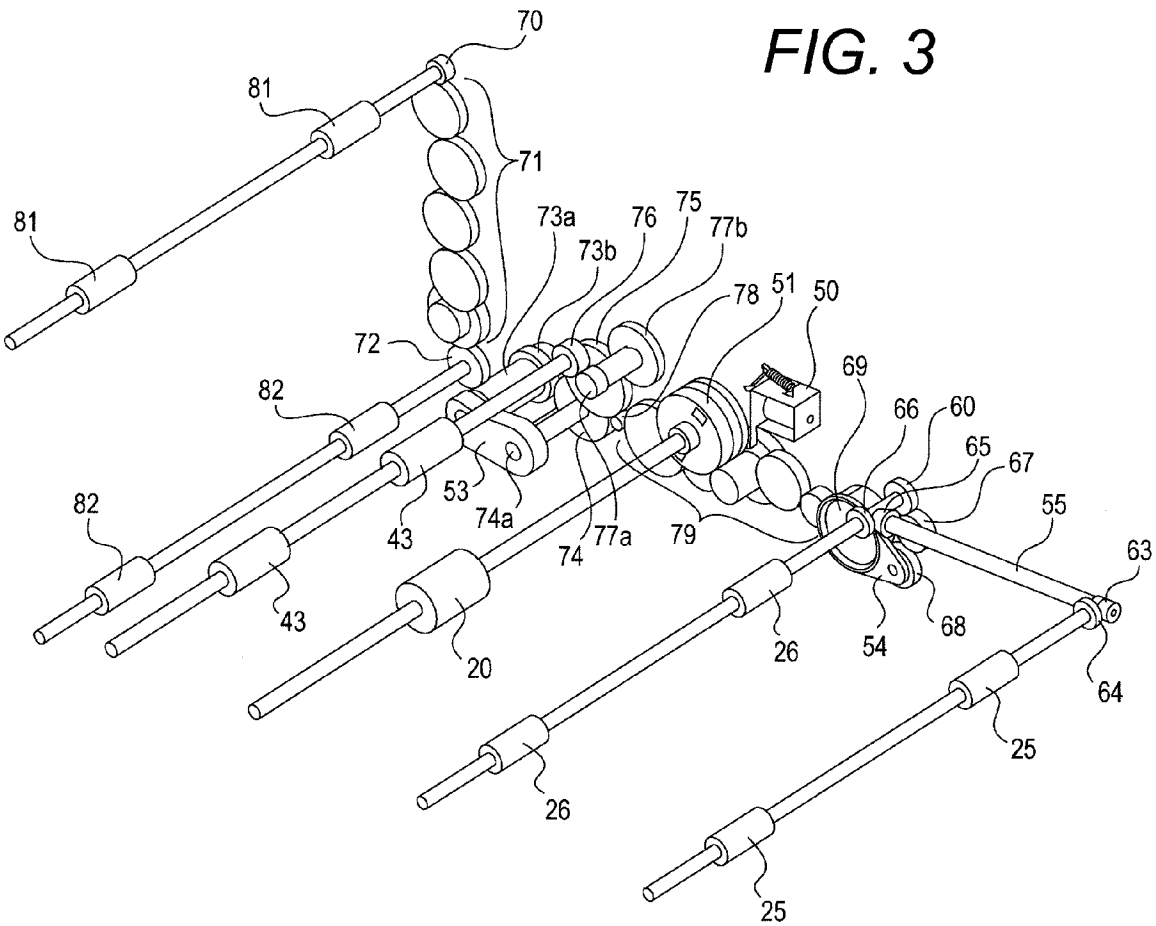
FIG. 3 is a perspective view for illustrating a driving gear train and conveyance rollers of the image forming apparatus according to the present invention.

Next, with reference to FIG. 3, a configuration of driving force transmission paths of the recording medium conveyance apparatus in the image forming apparatus is described. The recording medium conveyance apparatus illustrated as an example in this case includes the feeding roller 20, the feeding rollers 25 and 26, the registration rollers 43, and the double-side sheet conveyance rollers 81 and 82. FIG. 3 is a perspective view for illustrating a relationship between the feeding roller 20, the feeding rollers 25 and 26, the registration rollers 43, and the double-side sheet conveyance rollers 81 and 82, and a driving gear train serving as the driving force transmission paths.

Transmission paths configured to transmit a driving force to the rollers in the recording medium conveyance apparatus according to this embodiment include a first transmission path configured to transmit rotation of the driving unit to the feeding rollers 25 and 26 serving as the first feeding device, a second transmission path configured to transmit the rotation of the driving unit to the feeding roller 20 serving as the second feeding device, a third transmission path configured to transmit the rotation of the driving unit to the registration rollers 43, and a fourth transmission path including a branch portion branched from the third transmission path and configured to transmit the rotation of the driving unit to the double-side sheet conveyance rollers 81 and 82 serving as the double-side printing conveyance devices.

The driving unit is configured to rotate by a driving force in a first rotation direction or in a second rotation direction that is reverse to the first rotation direction. In this case, although not shown, a pulse motor is used as the driving unit.

As illustrated in FIG. 3, the first transmission path includes a motor driving gear 78, an idler gear train 79, an oscillating fulcrum gear 69, an oscillating gear 68, and gears 67, 60, 65, and 63. The motor driving gear 78 is driven by the motor (not shown) serving as the driving unit. The idler gear train 79 is a gear train made up of a plurality of gears including a gear configured to mesh with the motor driving gear 78. The oscillating fulcrum gear 69 is configured to mesh with another gear of the idler gear train 79, and serves as an oscillating fulcrum of an oscillating plate 54. The oscillating gear 68 is supported by the oscillating plate 54, and configured to mesh with the oscillating fulcrum gear 69 so as to be rotated in conjunction with rotation of the oscillating fulcrum gear 69 and moved in its rotation direction. The gear 67 is configured to mesh with the oscillating gear 68. The gear 60 is formed integrally with a face gear 66 and configured to mesh with the gear 67 so as to drive the manual feeding rollers 26. The gear 65 is formed integrally with the gear 63 through intermediation of a shaft 55 and configured to mesh with the face gear 66. A face gear 64 is configured to mesh with the gear 63 so as to drive the manual feeding rollers 25.

On the first transmission path, the oscillating fulcrum gear 69, the oscillating plate 54, and the oscillating gear 68 form a first clutch configured to transmit the rotation of the driving unit only in one direction. Specifically, the first clutch including the oscillating fulcrum gear 69, the oscillating plate 54, and the oscillating gear 68 is configured to transmit rotation of the driving unit in the first rotation direction to the feeding rollers 25 and 26 and not to transmit rotation of the driving unit in the second rotation direction to the feeding rollers 25 and 26. Note that, what is called a pendulum gear (oscillating fulcrum gear 69, oscillating plate 54, and oscillating gear 68) is used as the first clutch in this case, but the first clutch is not limited thereto. Other configurations may be employed as long as the rotation only in the one direction is transmitted. The first clutch may be configured to regulate the transmission of the rotation in the second rotation direction to the feeding rollers 25 and 26.

As illustrated in FIG. 3, the second transmission path includes a partially-toothless gear 51 configured to receive the driving force through intermediation of the idler gear train 79 so as to drive the feeding roller 20, and a solenoid 50 configured to control the partially-toothless gear 51. In other words, in this configuration, the second transmission path is branched from the first transmission path. Further, the partially-toothless gear 51 and the solenoid 50 function as a third clutch configured to transmit the rotation of the driving unit only in the one direction to the feeding roller 20.

As illustrated in FIG. 3, the third transmission path includes the motor driving gear 78, a ratchet input gear 75, a gear 77 including a gear 77*b* and a gear 77*a* formed integrally with each other, and a gear 76. The ratchet input gear 75 is configured to mesh with the motor driving gear 78, and forms a ratchet gear serving as a second clutch described below. The gear 77*b* of the gear 77 is configured to mesh with the ratchet input gear 75. The gear 76 is configured to mesh with the gear 77*a* of the gear 77 so as to drive the registration rollers 43.

As illustrated in FIG. 3, the fourth transmission path is branched at the branch portion from the third transmission path. Further, the fourth transmission path includes an oscillating fulcrum gear 74, an oscillating plate 53, an oscillating gear 73 including an oscillating gear 73*b* and an oscillating gear 73*a* formed integrally with each other, a gear 72, a gear 70, and an idler gear train 71. The oscillating fulcrum gear 74 is configured to mesh with a ratchet output gear 58 (refer to FIG. 4) forming the ratchet gear serving as the second clutch described below. The oscillating fulcrum gear 74 serves as an oscillating fulcrum of the oscillating plate 53 (turning center 74*a*). The oscillating gear 73*b* is supported by the oscillating plate 53, and configured to mesh with the oscillating fulcrum gear 74 so as to be rotated in conjunction with rotation of the oscillating fulcrum gear 74 and moved in its rotation direction. The gear 72 is configured to mesh with the oscillating gear 73*a* so as to drive the double-side sheet conveyance rollers 82. The gear 70 is configured to drive the double-side sheet conveyance rollers 81. The idler gear train 71 is a gear train made up of a plurality of gears including a gear configured to mesh with the gear 72 and a gear configured to mesh with the gear 70. The idler gear train 71 is configured to transmit the rotation to the gears 70 and 72 each configured to drive the double-side sheet conveyance rollers.

On the fourth transmission path, the oscillating fulcrum gear 74, the oscillating plate 53, the oscillating gear 73, and a spring 52 form a connecting portion configured to cut off the transmission path in conjunction with an operation of opening the double-side printing unit 80 configured to hold the double-side sheet conveyance rollers 81 and 82. Specifically, the connecting portion including the oscillating fulcrum gear 74, the oscillating plate 53, the oscillating gear 73, and the spring 52 is configured to cut off the transmission path by causing the gear 72 of the double-side printing unit 80, which meshes with the oscillating gear 73, to be separated away from the oscillating gear 73 in conjunction with the opening of the double-side printing unit 80. Note that, what is called a pendulum gear (oscillating fulcrum gear 74, oscillating plate 53, oscillating gear 73, and spring 52) is used as the connecting portion in this case, but the connecting portion is not limited thereto. Other configurations may be employed as long as the transmission path is cut off in conjunction with the operation of opening the unit.

Figure 4:
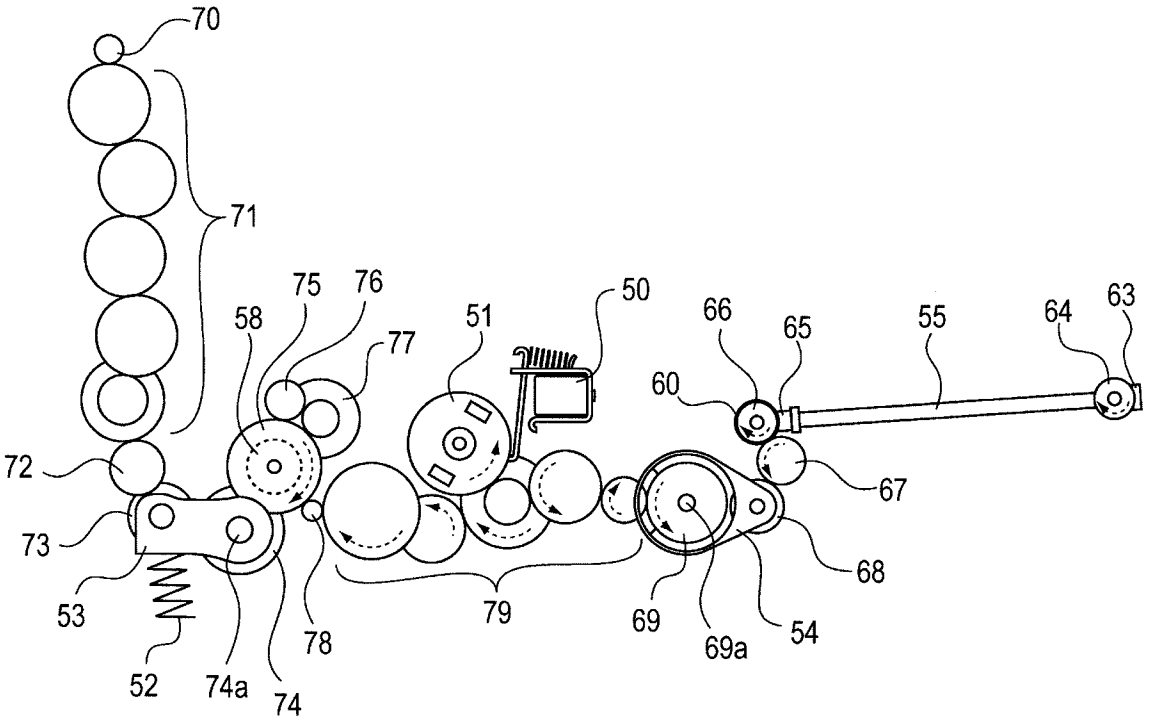
FIG. 4 is a sectional view for illustrating a state in which a motor driving gear of the driving gear train of the image forming apparatus according to the present invention is rotated in a counterclockwise direction.

FIG. 4 is a schematic sectional view for illustrating the driving gear train described above. In FIG. 4, the driving gear train includes the ratchet output gear 58 and the spring 52 configured to urge the oscillating plate 53.

<<Configuration of Ratchet Gear>>

Figure 5:
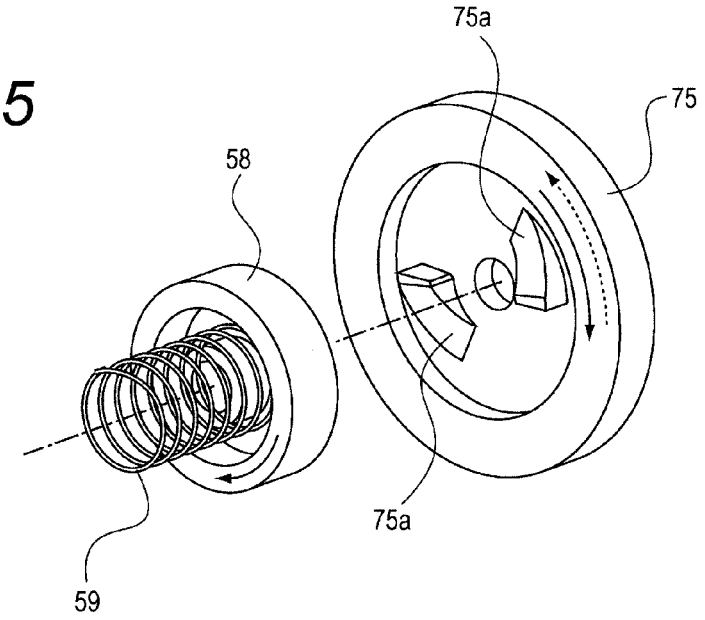
FIG. 5 is a detailed perspective view for illustrating a ratchet gear of the image forming apparatus according to the present invention.
Figure 6:
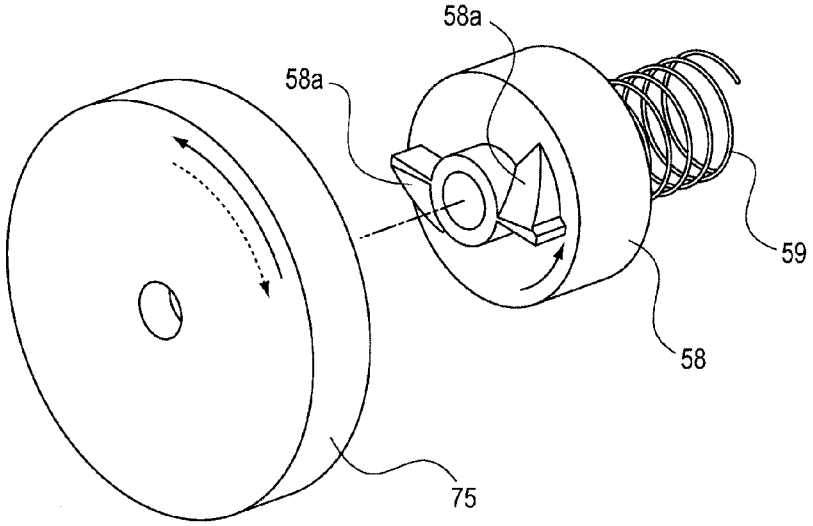
FIG. 6 is another detailed perspective view for illustrating the ratchet gear of the image forming apparatus according to the present invention, which is viewed from a side opposite to that in FIG. 5.
Figure 7:
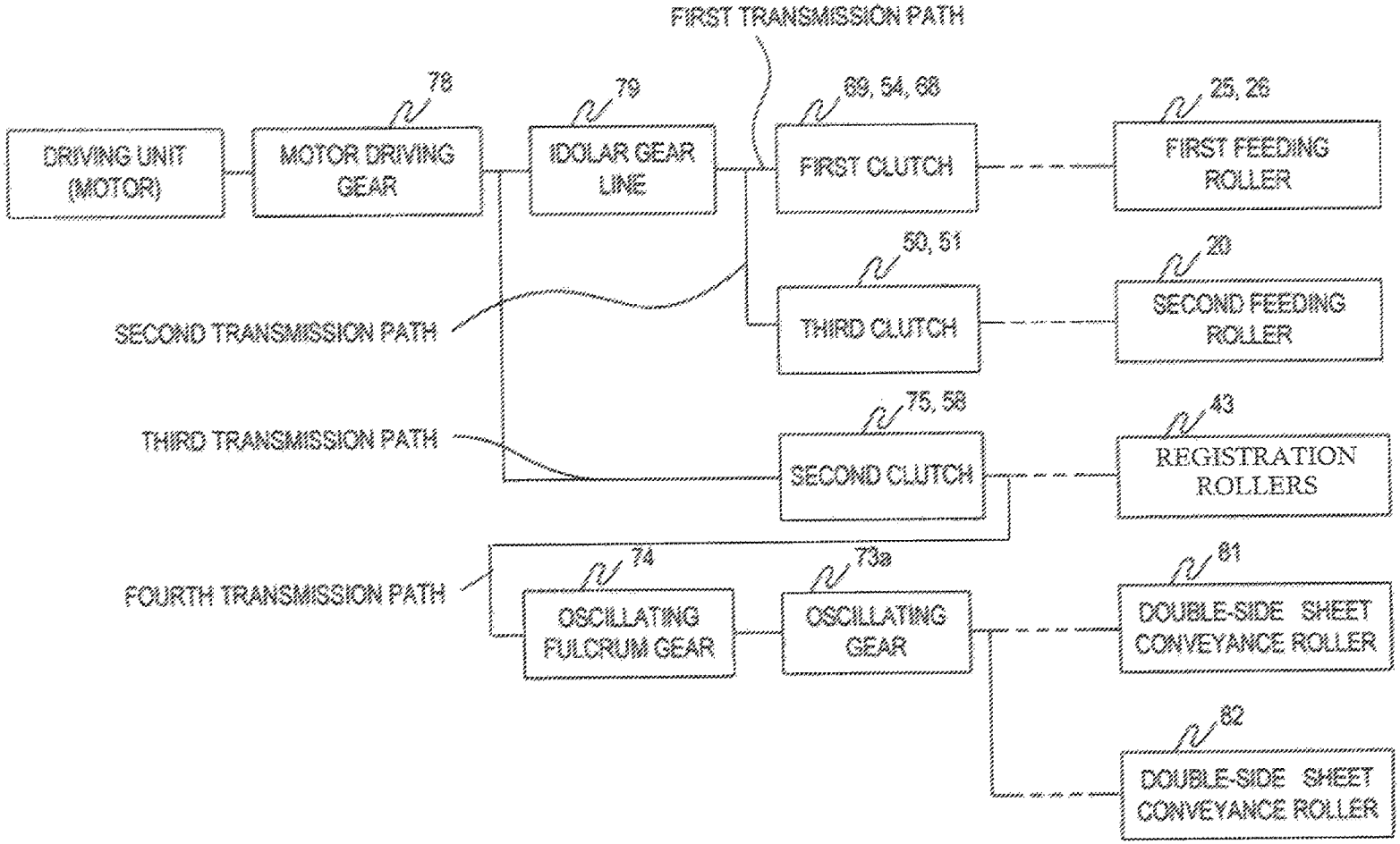
FIG. 7 is a block diagram for illustrating configurations of transmission paths between a motor and roller pairs and switching devices of the transmission paths.

Next, with reference to FIG. 5 and FIG. 6, the configuration of the ratchet gear serving as the second clutch is described. FIG. 5 is a detailed view (perspective view) for illustrating the ratchet gear. As illustrated in FIG. 5, claws 75*a* are formed integrally with the ratchet input gear 75, and a spring 59 is configured to urge the ratchet output gear 58 toward the ratchet input gear 75.

FIG. 6 is another detailed view (perspective view) in which the ratchet gear illustrated in FIG. 5 is viewed from an opposite side. As illustrated in FIG. 6, claws 58*a* are formed integrally with the ratchet output gear 58. The ratchet input gear 75 and the ratchet output gear 58 are configured to be brought into press contact with each other by the spring 59.

When the ratchet input gear 75 is rotated in the direction of the solid-line arrow in FIG. 5, the claws 75*a* of the ratchet input gear 75 mesh with the claws 58*a* of the ratchet output gear 58. With this, the driving force is transmitted from the claws 75*a* to the claws 58*a* so as to rotate the ratchet output gear 58 in the direction of the solid-line arrow. Meanwhile, when the ratchet input gear 75 is rotated in the direction of the broken-line arrow in FIG. 5, slope portions of the claws 75*a* and the claws 58*a* cause the ratchet input gear 75 to be idled. With this, the driving force is not transmitted to the ratchet output gear 58. In this way, the ratchet gear serving as the second clutch transmits the rotation of the driving unit only in the one direction. The second clutch may be configured to regulate the transmission of the rotation to the ratchet output gear 58.

Note that, in the configuration illustrated as an example, the ratchet gear serving as the second clutch is arranged at the above-mentioned branch portion between the fourth transmission path and the third transmission path, but the present invention is not limited thereto. The second clutch may be arranged at a transmission path between the driving unit and the branch portion. Further, the second clutch including the ratchet gear made up of the ratchet input gear 75, the ratchet output gear 58, and the spring 59 is configured to transmit the rotation of the driving unit only in the one direction. Specifically, the second clutch including the ratchet gear is configured to transmit the rotation of the driving unit in the second rotation direction to the registration rollers 43 and the double-side sheet conveyance rollers 81 and 82 and not to transmit the rotation of the driving unit in the first rotation direction to the registration rollers 43 and the double-side sheet conveyance rollers 81 and 82. Note that, what is called a ratchet gear (ratchet input gear 75, ratchet output gear 58, and spring 59) is used as the second clutch in this case, but the second clutch is not limited thereto. Other configurations may be employed as long as the rotation only in the one direction is transmitted. The second clutch may be configured to regulate the transmission of the rotation in the first rotation direction to the registration rollers 43 and the double-side sheet conveyance rollers 81 and 82. The configurations of the transmission paths between the motor and the roller pairs and the switching devices of the transmission paths as described above are illustrated in FIG. 7.

<<Driving Operation>>

Figure 8:
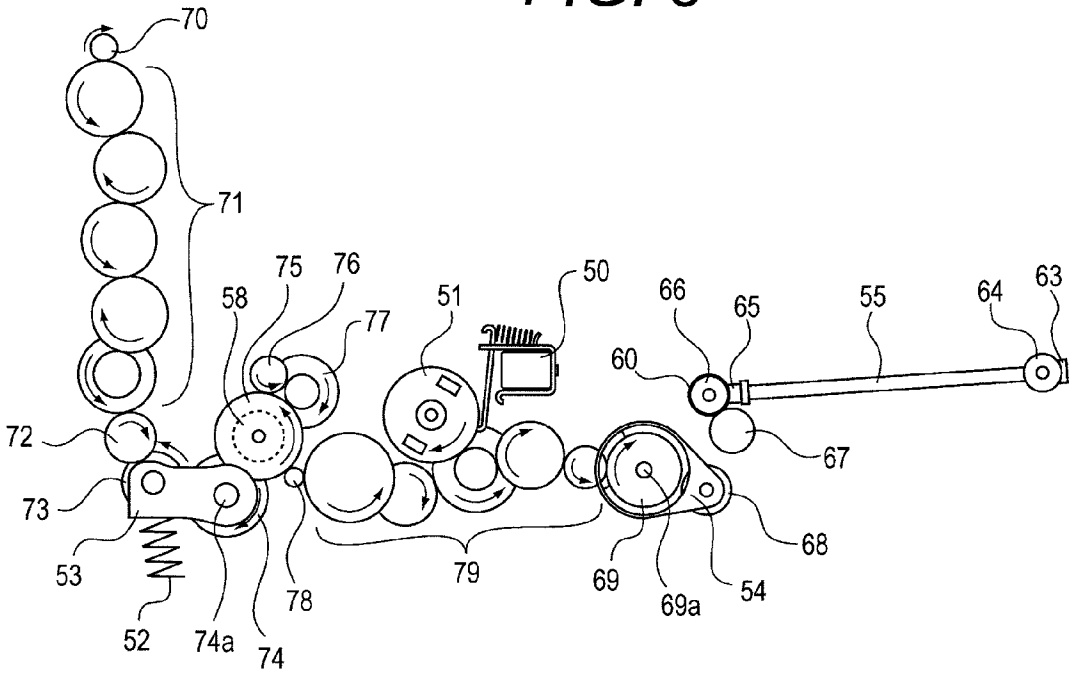
FIG. 8 is a sectional view for illustrating a state in which the motor driving gear of the driving gear train of the image forming apparatus according to the present invention is rotated in a clockwise direction.

Next, with reference to FIG. 4 and FIG. 8, a driving operation of the driving gear train is described. FIG. 4 is a sectional view for illustrating a driving operation when the motor is rotated in a counterclockwise direction. FIG. 8 is a sectional view for illustrating a driving operation when the motor is rotated in a clockwise direction.

First, with reference to FIG. 4, the driving operation when the motor is rotated in the counterclockwise direction, that is, the first rotation direction is described.

When the motor is rotated in the counterclockwise direction, the motor driving gear 78 is rotated in the counterclockwise direction so as to rotate the oscillating fulcrum gear 69 in the direction of the broken-line arrow through intermediation of the idler gear train 79. Then, the rotation causes the oscillating plate 54 to oscillate in the direction of the broken-line arrow, thereby bringing the oscillating gear 68 to a position of meshing with the gear 67. With this, the face gear 66 is rotated so as to drive and rotate the face gear 64 through intermediation of the gear 65, the shaft 55, and the gear 63. In this way, the manual feeding rollers 26 and the manual feeding rollers 25 are rotated.

The partially-toothless gear 51 is rotated in the counterclockwise direction (direction of the broken-line arrow) by the driving force transmitted thereto through intermediation of the idler gear train 79.

Further, when the motor is rotated in the counterclockwise direction, the ratchet input gear 75 is rotated in the clockwise direction (direction of the broken-line arrow). As a result, the claws 75*a* and 58*a* described above are idled, and hence the ratchet output gear 58 is not rotated. With this, on a downstream side with respect to the ratchet output gear 58, the gears 77 (77*b* and 77*b*) and 76, the oscillating fulcrum gear 74, the oscillating gear 73*b* (73*a*), the gear 72, the idler gear train 71, and the gear 70 are not rotated. Thus, even when the motor is rotated in the counterclockwise direction, the rotation is not transmitted by the ratchet gear. Therefore, the registration rollers 43 and the double-side sheet conveyance rollers 81 and 82 are not rotated.

Next, with reference to FIG. 8, the driving operation when the motor is rotated in the clockwise direction, that is, the second rotation direction is described.

When the motor is rotated in the clockwise direction, the motor driving gear 78 is rotated in the clockwise direction so as to rotate the oscillating fulcrum gear 69 in the direction of the solid-line arrow through intermediation of the idler gear train 79. Then, the rotation causes the oscillating plate 54 to oscillate in the direction of the solid-line arrow, thereby bringing the oscillating gear 68 to a position separated away from the gear 67 so as not to mesh with the gear 67. With this, the gear train on a downstream side with respect to the gear 67 is not rotated, and hence the manual feeding rollers 26 and the manual feeding rollers 25 are not rotated.

The partially-toothless gear 51 is rotated in the clockwise direction (direction of the solid-line arrow) by the driving force transmitted thereto through intermediation of the idler gear train 79.

Further, when the motor is rotated in the clockwise direction, the ratchet input gear 75 is rotated in the counterclockwise direction (direction of the solid-line arrow). As a result, the driving force is transmitted to the claws 58*a* through intermediation of the claws 75*a* described above, and hence the ratchet output gear 58 is rotated. When the ratchet output gear 58 is rotated, the registration rollers 43 are rotated through intermediation of the gear 77 (77*b* and 77*a*) and the gear 76. Further, when the ratchet output gear 58 is rotated, the oscillating fulcrum gear 74, the oscillating gears 73*b* and 73*a*, the gear 72, the idler gear train 71, and the gear 70 are driven. With this, the double-side sheet conveyance rollers 81 and 82 are rotated.

<<Printing Operation>>

Next, a feeding operation and a printing operation in the recording medium conveyance apparatus performed by the driving gear train are described.

First, with reference to FIG. 2, an operation of feeding the recording medium S through the manual feeding port 30 with use of the manual feeding rollers 25 and 26 is described.

As illustrated in FIG. 2, when the recording medium detecting device 27 detects the recording medium S inserted through the manual feeding port 30 by an operator, the motor is rotated in the first rotation direction so as to rotate the motor driving gear 78 in the counterclockwise direction. With this, the manual feeding rollers 25 and the manual feeding rollers 26 are rotated as described above.

The recording medium S, which is guided to the nips of the manual feeding rollers 25 by the operator, is fed to pass through the manual feeding rollers 26, and then a leading edge of the recording medium S is detected by a detecting device 28. After the leading edge of the recording medium S is detected, the recording medium S is conveyed by a predetermined amount to the feeding roller 20. Then, the motor is stopped so as to stop the manual feeding rollers 25 and the manual feeding rollers 26.

Then, when a printing signal is input, the motor is rotated in the second rotation direction so as to rotate the motor driving gear 78 in the clockwise direction. With this, the partially-toothless gear 51, the gear 76, the gear 72, and the gear 70 are driven. Then, the solenoid 50 is activated so as to rotate the partially-toothless gear 51, which causes the feeding roller 20 to feed the recording medium S that has been guided by the manual feeding rollers 25 and the manual feeding rollers 26.

The recording medium S fed as described above is guided to the registration rollers 43 that are driven to rotate in conjunction with the rotation of the motor driving gear 78 in the clockwise direction, and then subjected to skew-feeding correction by the registration rollers 43. Next, the recording medium S is subjected to image transfer in the secondary transfer portion, and then reaches the delivery rollers 22 through the fixing unit 21.

At the time of one-side printing, the recording medium S, which reaches the delivery rollers 22, is delivered onto the delivery tray 23. Meanwhile, at the time of the double-side printing, after the vicinity of the trailing edge of the recording medium S reaches the delivery rollers 22, the switching member 62 is moved to the double-side printing conveyance position (position indicated by the broken line in FIG. 2) by the driving unit (not shown). Then, the delivery rollers 22 is reversely rotated by the driving unit (not shown) so as to feed the recording medium S to the double-side printing unit 80.

In conjunction with the rotation of the motor driving gear 78 in the clockwise direction, the double-side sheet conveyance rollers 81 and 82 in the double-side printing unit 80 are rotated in the directions of the arrows in FIG. 2. The recording medium S is conveyed to the registration rollers 43 by the double-side sheet conveyance rollers 81 and 82. Then, the recording medium S is subjected to printing on the second side similarly to printing on the first side (double-side printing), and then delivered onto the delivery tray 23 by the delivery rollers 22. In this way, at the time of printing on the recording medium S fed through the manual feeding port 30, the motor is rotated in the first rotation direction, and then driven to rotate in the second rotation direction.

Next, an operation of feeding the recording medium S from the feeding tray 19 with use of the feeding roller 20 is described.

When the printing signal is input, the motor is rotated in the second rotation direction so as to rotate the motor driving gear 78 in the clockwise direction. With this, the partially-toothless gear 51, the gear 76, the gear 72, and the gear 70 are driven. Then, the solenoid 50 is activated so as to rotate the partially-toothless gear 51, which causes the feeding roller 20 to separate one by one and feed the recording media S from the feeding tray 19.

The recording medium S fed as described above is subjected to the one-side printing or the double-side printing similarly to the manual feeding, and then delivered onto the delivery tray 23 by the delivery rollers 22. In this way, at the time of printing on the recording medium S fed from the feeding tray 19, the motor is driven to rotate only in the clockwise direction, that is, the second rotation direction.

<<Operation of Opening and Closing Double-Side Printing Unit>>

Figure 9:
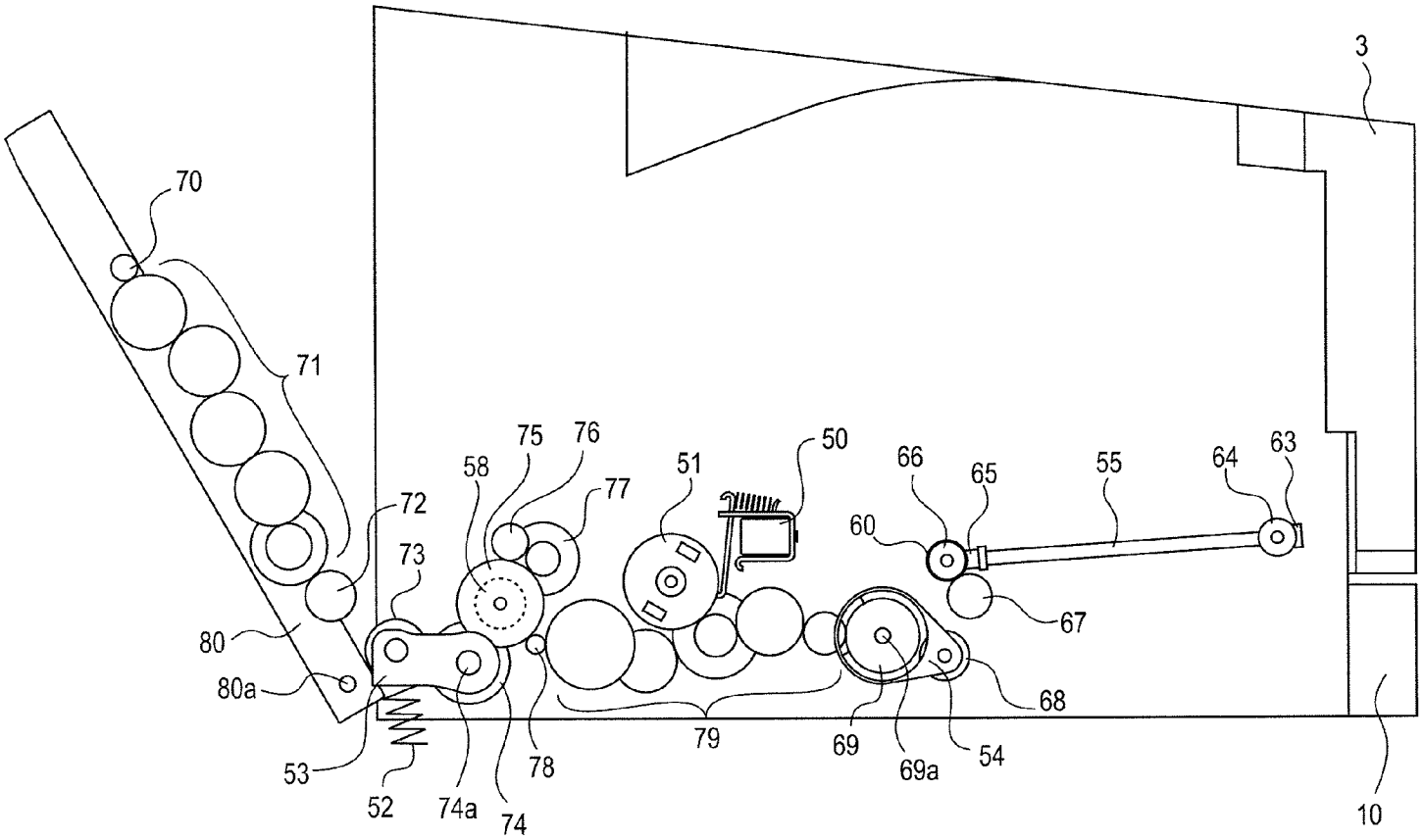
FIG. 9 is a sectional view for illustrating a state in which a double-side printing unit of the image forming apparatus according to the present invention is opened.

Next, an operation of opening and closing the double-side printing unit is described. FIG. 9 is a schematic sectional view for illustrating a state in which the double-side printing unit 80 is opened with respect to the main body 2 of the image forming apparatus 1.

As illustrated in FIG. 9, the double-side printing unit 80 is configured to be openable and closable with respect to the main body 2 of the image forming apparatus 1 about a rotation center 80*a*.

As illustrated in FIG. 9, when a jam of the recording medium S or the like occurs in the double-side printing unit 80, the operator can open the double-side printing unit 80 about the rotation center 80*a* so as to remove the jam. At this time, the gear 72 on the double-side printing unit 80 side is moved together with the opened double-side printing unit 80 to a position separated away from the oscillating gear 73*a* on the side of the main body 2. Thus, the gear 72 is disengaged from the oscillating gear 73*a*. When the operator closes the double-side printing unit 80 after removing the jam, the gear 72 is moved together with the closing double-side printing unit 80 to a position of being brought into press contact with the oscillating gear 73*a* on the side of the main body 2. With this, the gear 72 meshes again with the oscillating gear 73.

According to the configuration described above, when the motor driving gear 78 is rotated in the counterclockwise direction, that is, the first rotation direction, the manual feeding rollers 25 and 26 are driven while the double-side sheet conveyance rollers 81 and 82 are not driven. Meanwhile, when the motor driving gear 78 is rotated in the clockwise direction, that is, the second rotation direction, the registration rollers 43 and the double-side sheet conveyance rollers 81 and 82 are driven while the manual feeding rollers 25 and 26 are not driven. Thus, loads of the manual feeding rollers 25 and 26, and loads of the registration rollers 43 and the double-side sheet conveyance rollers 81 and 82 are not applied at once to the motor configured to drive the motor driving gear 78.

In this way, the loads generated when driving the large number of rollers are applied to the motor in a distributed manner, and hence the motor to be used may be small, output low torque, and be inexpensive.

In addition, during the rotation of each of the manual feeding rollers 25 and 26, the registration rollers 43 or the double-side sheet conveyance rollers 81 and 82 are not rotated. Thus, abrasion of surfaces of the rollers is suppressed.

Further, in this embodiment, the ratchet gear (one way gear) serves as the branch portion between the third transmission path and the fourth transmission path, which transmits the driving force to the registration rollers and the double-side sheet conveyance rollers. In this way, the conveyance rollers of the two types can be controlled with a single clutch.

According to this embodiment, the feeding roller 20, the manual feeding rollers 25 and 26, the registration rollers 43, and the double-side sheet conveyance rollers 81 and 82 can be driven with the single driving unit. In addition, not all the loads generated when driving the rollers are applied to the driving unit at once when driving the driving unit. Thus, cost reduction and space saving of the apparatus can be achieved.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-234096, filed Nov. 19, 2014, which is hereby incorporated by reference herein in its entirety.

What is claimed is:

1. A recording medium conveyance apparatus, comprising:

a driving unit configured to be driven to rotate in a first rotation direction and a second rotation direction that is reverse to the first rotation direction;

a first feeding device configured to feed a recording medium;

a first transmission path configured to transmit rotation of the driving unit to the first feeding device;

a first clutch arranged on the first transmission path, which is configured to transmit rotation of the driving unit in the first rotation direction to the first feeding device and not transmit rotation of the driving unit in the second rotation direction to the first feeding device;

a second feeding device arranged independently of the first feeding device, which is configured to feed a recording medium;

a second transmission path configured to transmit the rotation of the driving unit to the second feeding device;

a double-side printing conveyance device arranged on a double-side sheet conveyance path;

a conveyance device configured to convey the recording medium fed by one of the first feeding device and the second feeding device;

a third transmission path configured to transmit the rotation of the driving unit to the conveyance device;

a fourth transmission path comprising a branch portion branched from the third transmission path, which is configured to transmit the rotation of the driving unit to the double-side printing conveyance device; and a second clutch arranged at the branch portion or on a transmission path between the driving unit and the branch portion, which is configured to transmit the rotation of the driving unit in the second rotation direction to the conveyance device and the double-side printing conveyance device and not to transmit the rotation of the driving unit in the first rotation direction to the conveyance device and the double-side printing conveyance device.

2. A recording medium conveyance apparatus according to claim 1, further comprising a third clutch arranged on the second transmission path, which is configured to transmit the rotation of the driving unit in the second rotation direction to the second feeding device and not transmit the rotation of the driving unit in the first rotation direction to the second feeding device.

3. A recording medium conveyance apparatus according to claim 2, wherein the second transmission path comprises a branch portion branched from the first transmission path, and wherein the third clutch is arranged on the second transmission path on a downstream side with respect to the branch portion of the second transmission path.

4. A recording medium conveyance apparatus according to claim 1, wherein the driving unit comprises a pulse motor.

5. A recording medium conveyance apparatus according to claim 1, further comprising:

a unit configured to be openable and closable with respect to a main body of the recording medium conveyance apparatus and hold the double-side printing conveyance device; and a connecting portion arranged on the fourth transmission path on a downstream side with respect to the branch portion of the third transmission path, which is configured to cut off, in conjunction with an operation of opening the unit, transmission of the rotation of the driving unit from the third transmission path.

6. A recording medium conveyance apparatus according to claim 5, wherein the connecting portion comprises an oscillating gear arranged in the main body of the recording medium conveyance apparatus, which is configured to oscillate, wherein the unit comprises a gear configured to mesh with the oscillating gear, and wherein, when the unit configured to hold the double-side printing conveyance device is opened, the gear is separated away from the oscillating gear so that the fourth transmission path is cut off.

7. A recording medium conveyance apparatus, comprising:

a driving unit configured to rotate by a driving force in a first rotation direction and a second rotation direction that is reverse to the first rotation direction;

a first feeding device configured to feed a recording medium;

a first transmission path configured to transmit rotation of the driving unit to the first feeding device;

a first clutch arranged on the first transmission path, which is configured to transmit rotation of the driving unit in the first rotation direction to the first feeding device and regulate transmission of rotation of the driving unit in the second rotation direction to the first feeding device;

a second feeding device arranged independently of the first feeding device, which is configured to feed a recording medium;

a second transmission path configured to transmit the rotation of the driving unit to the second feeding device;

a double-side printing conveyance device arranged on a double-side sheet conveyance path;

a conveyance device configured to convey the recording medium fed by one of the first feeding device and the second feeding device;

a third transmission path configured to transmit the rotation of the driving unit to the conveyance device;

a fourth transmission path comprising a branch portion branched from the third transmission path, which is configured to transmit the rotation of the driving unit to the double-side printing conveyance device; and a second clutch arranged at the branch portion or on a transmission path between the driving unit and the branch portion, which is configured to transmit the rotation of the driving unit in the second rotation direction to the conveyance device and the double-side printing conveyance device and to regulate transmission of the rotation of the driving unit in the first rotation direction to the conveyance device and the double-side printing conveyance device.

8. An image forming apparatus, comprising:

a recording medium conveyance apparatus configured to convey a recording medium; and a transfer portion configured to transfer an image onto the recording medium fed to the recording medium conveyance apparatus, the recording medium conveyance apparatus comprising:

a driving unit configured to rotate by a driving force in a first rotation direction and a second rotation direction that is reverse to the first rotation direction;

a first feeding device configured to feed a recording medium;

a first transmission path configured to transmit rotation of the driving unit to the first feeding device;

a first clutch arranged on the first transmission path, which is configured to transmit rotation of the driving unit in the first rotation direction to the first feeding device and not transmit rotation of the driving unit in the second rotation direction to the first feeding device;

a second feeding device arranged independently of the first feeding device, which is configured to feed a recording medium;

a second transmission path configured to transmit the rotation of the driving unit to the second feeding device;

a double-side printing conveyance device arranged on a double-side sheet conveyance path;

a conveyance device configured to convey the recording medium fed by one of the first feeding device and the second feeding device;

a third transmission path configured to transmit the rotation of the driving unit to the conveyance device;

a fourth transmission path comprising a branch portion branched from the third transmission path, which is configured to transmit the rotation of the driving unit to the double-side printing conveyance device; and a second clutch arranged at the branch portion or on a transmission path between the driving unit and the branch portion, which is configured to transmit the rotation of the driving unit in the second rotation direction to the conveyance device and the double-side printing conveyance device and not to transmit the rotation of the driving unit in the first rotation direction to the conveyance device and the double-side printing conveyance device.

9. An image forming apparatus according to claim 8, wherein the recording medium conveyance apparatus further comprises a third clutch arranged on the second transmission path, which is configured to transmit the rotation of the driving unit in the second rotation direction to the second feeding device and not transmit the rotation of the driving unit in the first rotation direction to the second feeding device.

10. An image forming apparatus according to claim 9, wherein the second transmission path comprises a branch portion branched from the first transmission path, and wherein the third clutch is arranged on the second transmission path on a downstream side with respect to the branch portion.

11. An image forming apparatus according to claim 8, wherein the driving unit comprises a pulse motor.

12. An image forming apparatus according to claim 8, wherein the recording medium conveyance apparatus further comprises:

a unit configured to be openable and closable with respect to a main body of the recording medium conveyance apparatus and hold the double-side printing conveyance device; and a connecting portion arranged on the fourth transmission path on a downstream side with respect to the branch portion of the third transmission path, which is configured to cut off, in conjunction with an operation of opening the unit, transmission of the rotation of the driving unit from the third transmission path.

13. An image forming apparatus according to claim 12, wherein the connecting portion comprises an oscillating gear arranged in the main body of the image forming apparatus, which is configured to oscillate, wherein the unit comprises a gear configured to mesh with the oscillating gear, and wherein, when the unit configured to hold the double-side printing conveyance device is opened, the gear is separated away from the oscillating gear so that the fourth transmission path is cut off.

14. An image forming apparatus, comprising:

a recording medium conveyance apparatus configured to convey a recording medium; and a transfer portion configured to transfer an image onto the recording medium fed to the recording medium conveyance apparatus, the recording medium conveyance apparatus comprising:

a driving unit configured to rotate by a driving force in a first rotation direction and a second rotation direction that is reverse to the first rotation direction;

a first feeding device configured to feed a recording medium;

a first transmission path configured to transmit rotation of the driving unit to the first feeding device;

a first clutch arranged on the first transmission path, which is configured to transmit rotation of the driving unit in the first rotation direction to the first feeding device and regulate transmission of rotation of the driving unit in the second rotation direction to the first feeding device;

a second feeding device arranged independently of the first feeding device, which is configured to feed a recording medium;

a second transmission path configured to transmit the rotation of the driving unit to the second feeding device;

a double-side printing conveyance device arranged on a double-side sheet conveyance path;

a conveyance device configured to convey the recording medium fed by one of the first feeding device and the second feeding device;

a third transmission path configured to transmit the rotation of the driving unit to the conveyance device;

a fourth transmission path comprising a branch portion branched from the third transmission path, which is configured to transmit the rotation of the driving unit to the double-side printing conveyance device; and a second clutch arranged at the branch portion or on a transmission path between the driving unit and the branch portion, which is configured to transmit the rotation of the driving unit in the second rotation direction to the conveyance device and the double-side printing conveyance device and to regulate transmission of the rotation of the driving unit in the first rotation direction to the conveyance device and the double-side printing conveyance device.

* * * * *